US010640173B1

(12) United States Patent
Thomas, Jr.

(10) Patent No.: US 10,640,173 B1
(45) Date of Patent: May 5, 2020

(54) BOAT MOORING ASSEMBLY

(71) Applicant: William Thomas, Jr., Ingleside, IL (US)

(72) Inventor: William Thomas, Jr., Ingleside, IL (US)

( * ) Notice: Subject to any disclaimer, the term of this patent is extended or adjusted under 35 U.S.C. 154(b) by 0 days.

(21) Appl. No.: 16/210,199

(22) Filed: Dec. 5, 2018

(51) Int. Cl.
*B63B 21/00* (2006.01)

(52) U.S. Cl.
CPC ..... *B63B 21/00* (2013.01); *B63B 2021/001* (2013.01); *B63B 2021/004* (2013.01)

(58) Field of Classification Search
CPC ..... B63B 21/00; B63B 21/08; B63B 21/20; B63B 21/50; B63B 21/54; B63B 2021/00; B63B 2021/001; B63B 2021/002; B63B 2021/003; B63B 2021/004; B63B 2021/005; B63B 2021/20; B63B 2021/50
USPC ..... 114/230.1, 230.15, 230.16, 230.17, 114/230.18, 230.19
See application file for complete search history.

(56) References Cited

U.S. PATENT DOCUMENTS 2,979,014 A * 4/1961 Yordi ..... E02B 3/24 114/230.16
3,406,651 A * 10/1968 Jalbert ..... E02B 3/24 114/230.17
4,751,892 A 6/1988 Sechel
5,014,638 A * 5/1991 Ilves ..... B63B 21/00 114/230.18
5,499,591 A * 3/1996 Chippas ..... B63B 21/00 114/218
5,575,234 A * 11/1996 Dysarz ..... B63B 21/00 114/218
6,508,190 B1 1/2003 Norton
6,928,945 B1 8/2005 Tebo, Jr.
7,891,058 B2 2/2011 Kubli
8,091,499 B1 1/2012 Perez
8,109,222 B2 * 2/2012 Fuhrmann ..... B63B 21/00 114/230.15
8,225,463 B2 7/2012 Bourke
8,235,340 B2 * 8/2012 Carnevali ..... F16B 2/065 248/231.71
8,443,747 B1 5/2013 Cardarelli
8,714,098 B2 * 5/2014 Webb ..... B63B 21/00 114/230.18
2007/0289518 A1 * 12/2007 Lawson ..... B63B 21/00 114/230.27
2010/0206210 A1 * 8/2010 Fuhrmann ..... B63B 21/00 114/230.18
2013/0160691 A1 * 6/2013 Webb ..... B63B 21/00 114/230.18

* cited by examiner

*Primary Examiner* — Daniel V Venne

(57) ABSTRACT

A boat mooring assembly for mooring a boat to a dock includes a rod that comprises a plurality of nested sections so that the rod is selectively extensible. A pair of couplers is coupled singly to a first end and a second end of the rod. The couplers are configured to couple singly to a boat cleat and selectively to one of a dock cleat and a dock post to couple the boat to the dock.

14 Claims, 6 Drawing Sheets

BOAT MOORING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mooring assemblies and more particularly pertains to a new mooring assembly for mooring a boat to a dock.

BRIEF SUMMARY OF THE INVENTION

An embodiment of the disclosure meets the needs presented above by generally comprising a rod that comprises a plurality of nested sections so that the rod is selectively extensible. A pair of couplers is coupled singly to a first end and a second end of the rod. The couplers are configured to couple singly to a boat cleat and selectively to one of a dock cleat and a dock post to couple the boat to the dock.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
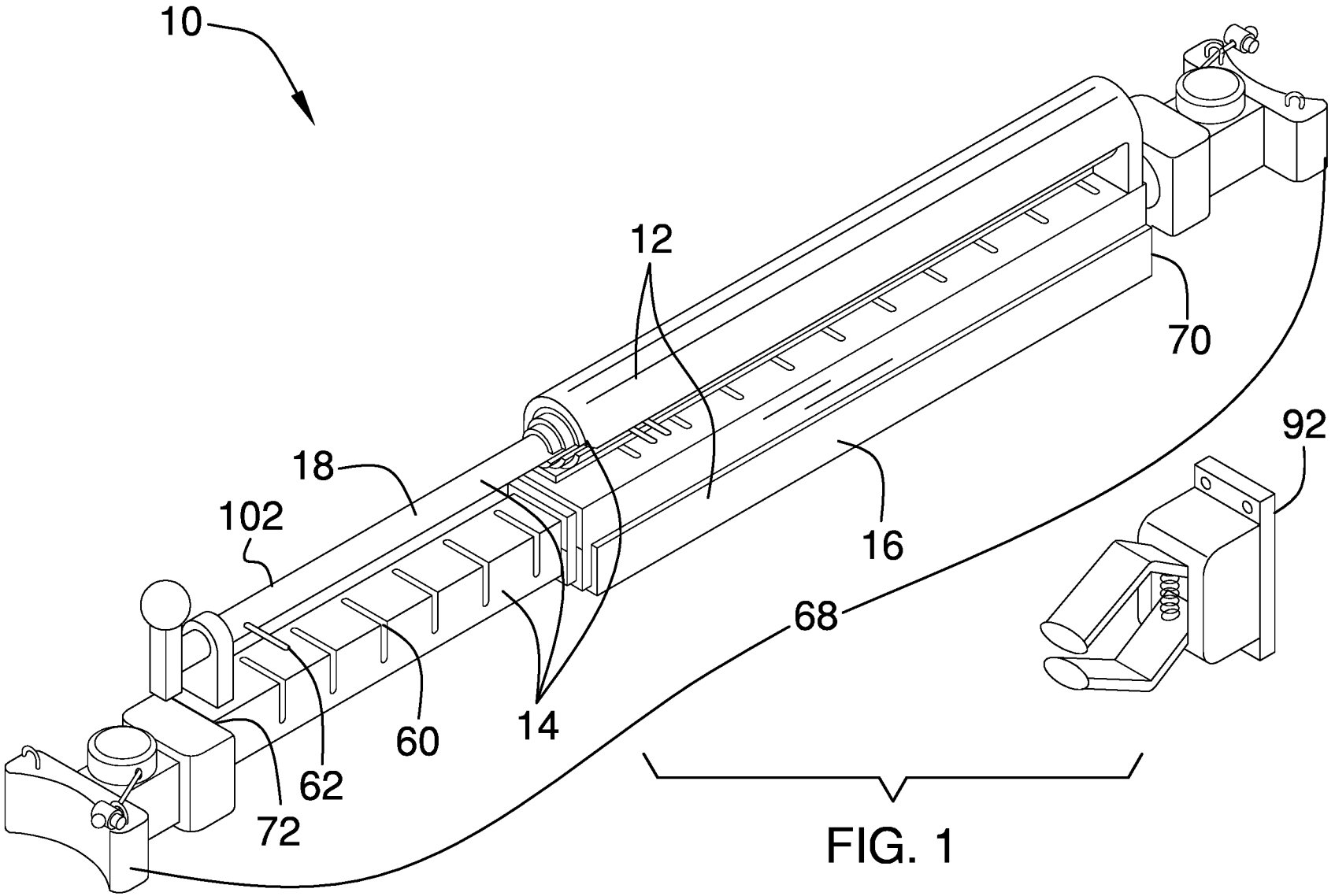
FIG. 1 is an isometric perspective view of a boat mooring assembly according to an embodiment of the disclosure.
Figure 2:
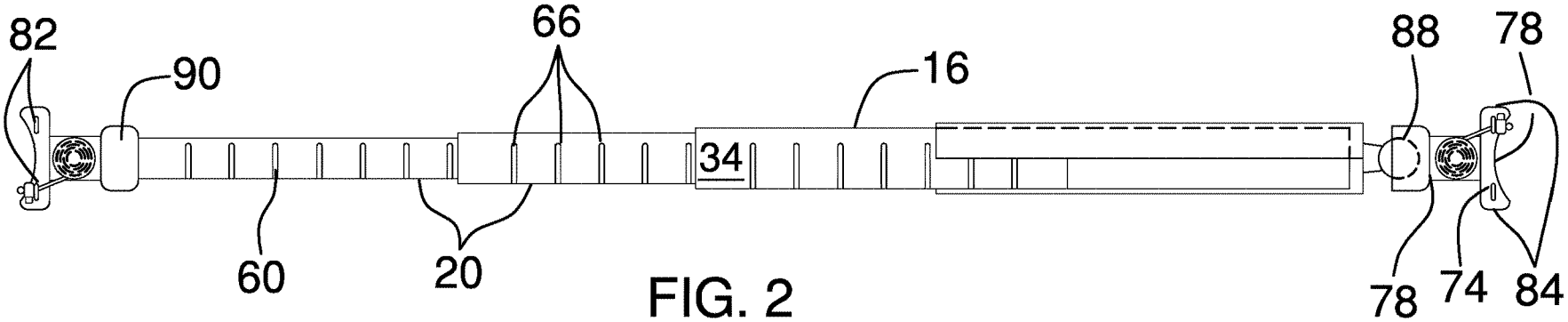
FIG. 2 is a top view of an embodiment of the disclosure.

With reference now to the drawings, and in particular to FIGS. 1 through 8 thereof, a new mooring assembly embodying the principles and concepts of an embodiment of the disclosure and generally designated by the reference numeral 10 will be described.

Figure 3:
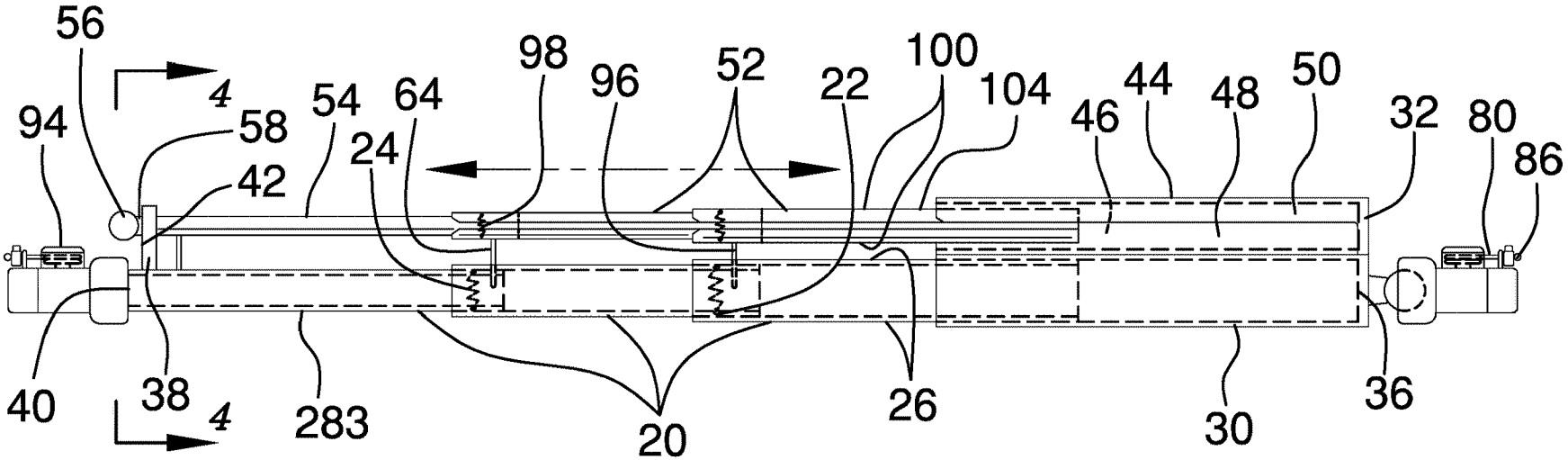
FIG. 3 is a side view of an embodiment of the disclosure.

As best illustrated in FIGS. 1 through 8, the boat mooring assembly 10 generally comprises a rod 12. The rod 12 comprises a plurality of nested sections 14 so that the rod 12 is selectively extensible. The rod 12 comprises a bar 16 and a pipe 18. The bar 16 comprises a plurality of nested pieces 20, which are tubular. The nested pieces 20 are selectively and sequentially extensible, as shown in FIG. 3.

Each nested piece 20 comprises a pair of bar pins 22 and a spring 24, as shown in FIG. 3. The bar pins 22 are coupled to and extendible from opposing faces 26 of the nested piece 20. The spring 24 is coupled to and extends between the bar pins 22 so that the spring 24 biases the bar pins 22 to an extended configuration. Each spring 24 has a respective tension so that the springs 24 have a variety of tensions. Each spring 24 is positioned to urge an associated pair of bar pins 22 from an associated nested piece 20 so that the associated pair of bar pins 22 frictionally couples to an adjacent nested piece 20. The tensions of the springs 24 increase for each nested piece 20 from an innermost nested piece 28 to an outermost nested piece 30 so that the nested pieces 20 are sequentially extended.

A first endplate 32 is coupled to and extends from an upper face 34 of the bar 16 proximate to a first endpoint 36 of the bar 16. A second endplate 38 is coupled to and extends from the upper face 34 of the bar 16 proximate to a second endpoint 40 of the bar 16. A hole 42 is positioned in the second endplate 38. A housing 44 is fixedly coupled to and extends from the first endplate 32. The housing 44 defines an interior space 46. The housing 44 is tubular and open-ended. A cutout 48 is positioned in a side 50 of the housing 44, as shown in FIG. 1.

The pipe 18 is rotatably coupled to the housing 44 and is positioned in the interior space 46. The pipe 18 comprises a plurality of nested segments 52. The nested segments 52 are selectively and sequentially extensible concurrently with the nested pieces 20 of the bar 16, as shown in FIG. 3. The plurality of nested segments 52 comprises an inner segment 54 that extends through the hole 42, as shown in FIG. 3. The pipe 18 is positioned longitudinally along the upper face 34 of the bar 16. A handle 56 is coupled to a terminus 58 of the inner segment 54.

Each of a plurality of first fasteners 60 is coupled to a respective nested piece 20 of the bar 16. Each of a plurality of second fasteners 62 is coupled to a respective nested segment 52 of the pipe 18. The second fasteners 62 are complementary to the first fasteners 60. Each second fastener 62 is positioned to couple to a respective first fastener 60 to fixedly position the plurality of nested sections 14 of the rod 12.

Figure 4:
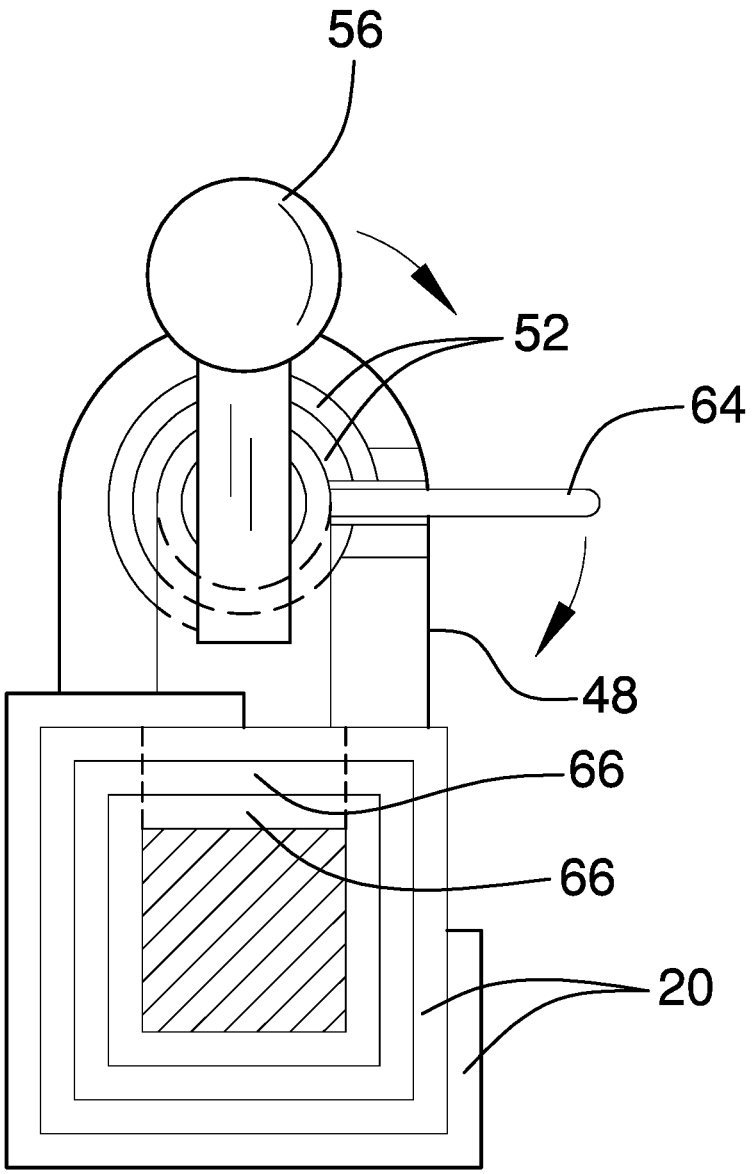
FIG. 4 is an end view of an embodiment of the disclosure.

The second fastener 62 comprises a pipe pin 64 that is coupled to and extends from the respective nested segment 52, as shown in FIG. 1. The first fastener 60 comprises a set of slots 66 that is positioned in the respective nested piece 20 of the bar 16. The handle 56 is configured to be grasped in a hand of a user to rotate the pipe 18 relative to the housing 44 so that each pipe pin 64 that is positioned on a nested segment 52 of the pipe 18 is rotated through the cutout 48 into associated slots 66 that are positioned in nested pieces 20 of the bar 16, as shown in FIG. 4. The pipe pins 64 fixedly position the pipe 18 and the bar 16 at a desired length.

Figure 7:
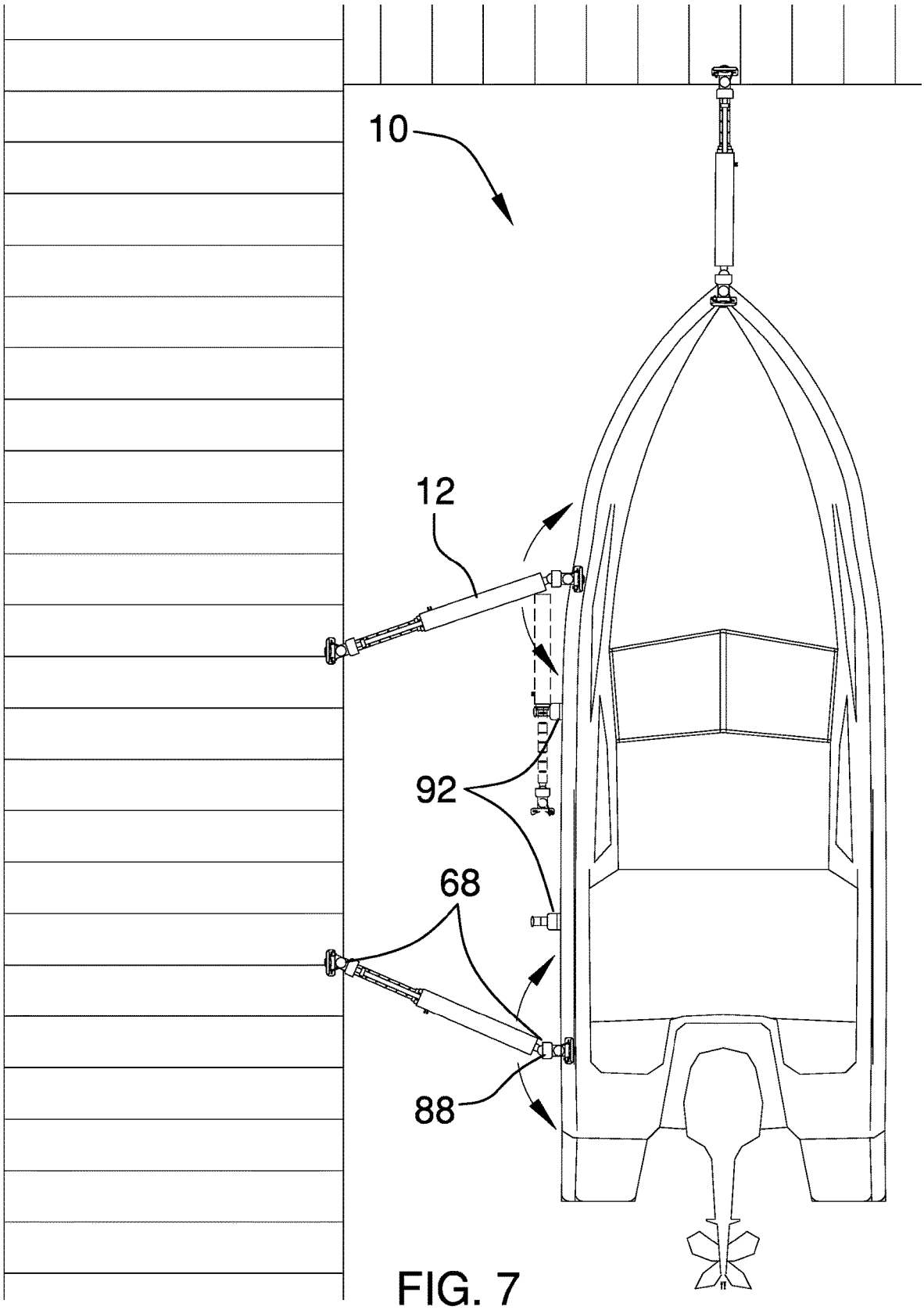
FIG. 7 is an in-use view of an embodiment of the disclosure.
Figure 8:
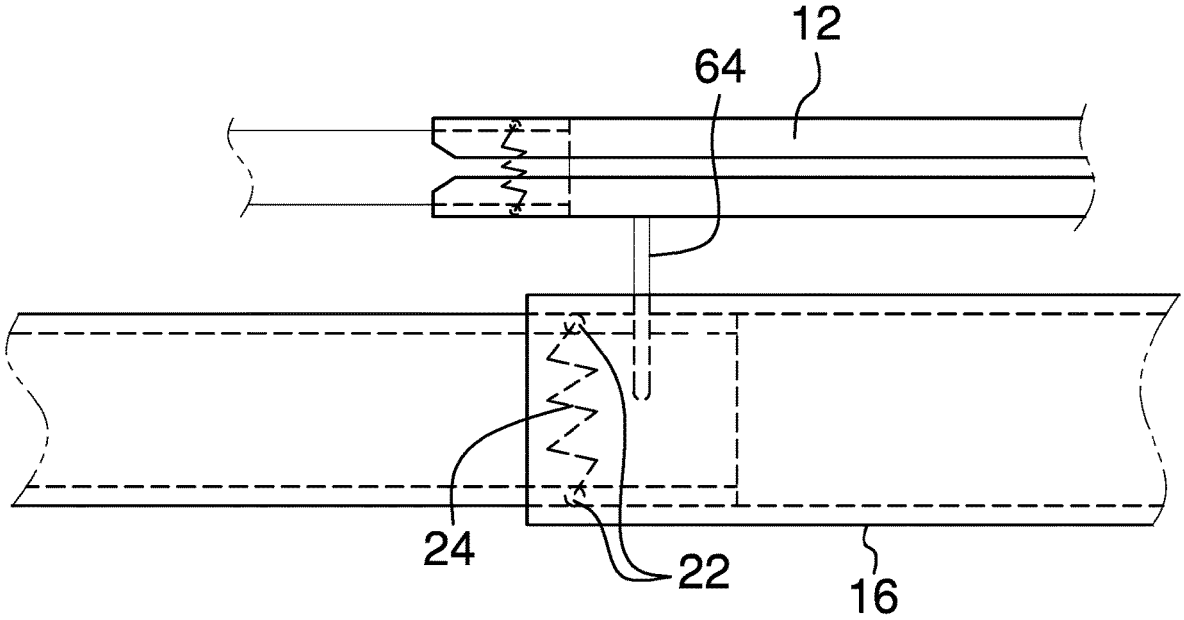
FIG. 8 is a detailed partial view of an embodiment of the disclosure.

A pair of couplers 68 is coupled singly to a first end 70 and a second end 72 of the rod 12, as shown in FIG. 1. The couplers 68 are configured to couple singly to a boat cleat and selectively to one of a dock cleat and a dock post to couple the boat to the dock, as shown in FIG. 7. A typical deployment of two assemblies 10 is depicted in FIG. 7, where each rod 12 extends transversely from the boat to the dock to maintain the boat in a desired position.

Figure 5:
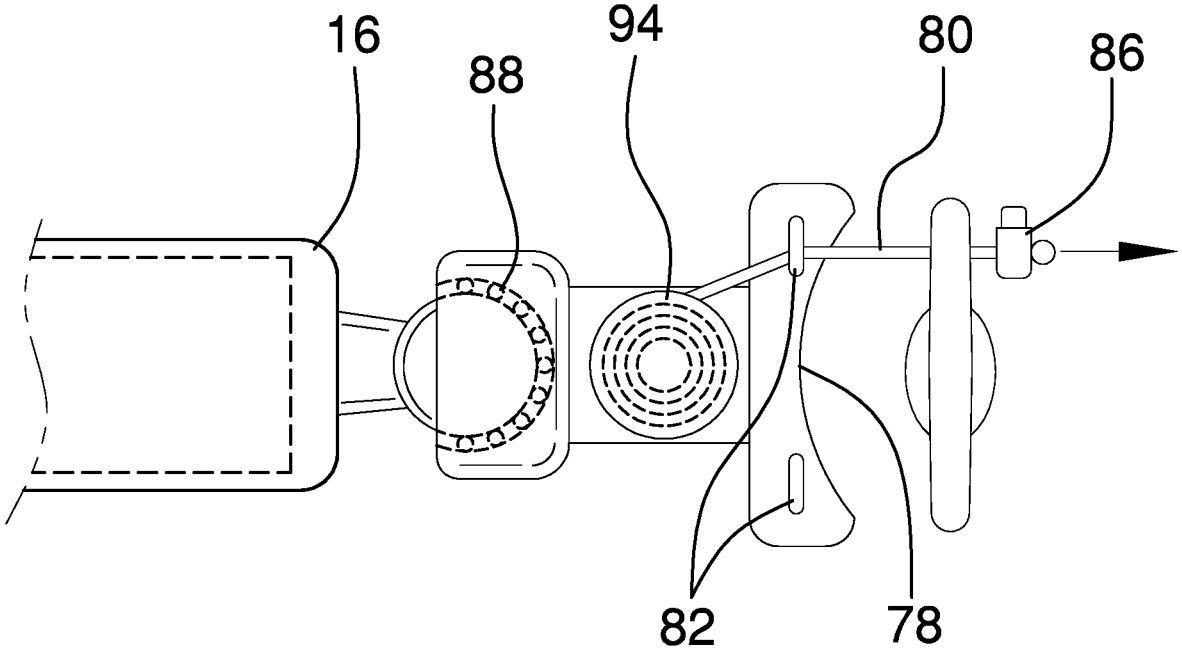
FIG. 5 is a cross-sectional view of an embodiment of the disclosure.

Each coupler 68 comprises a plate 74 that has a first face 76 that is coupled to the bar 16. The plate 74 has a second face 78 that is concavely shaped, as shown in FIG. 5. The concave shape of the second face 78 allows the plate 74 to be positioned adjacent to the dock post or a vertical member or the dock cleat.

Figure 6:
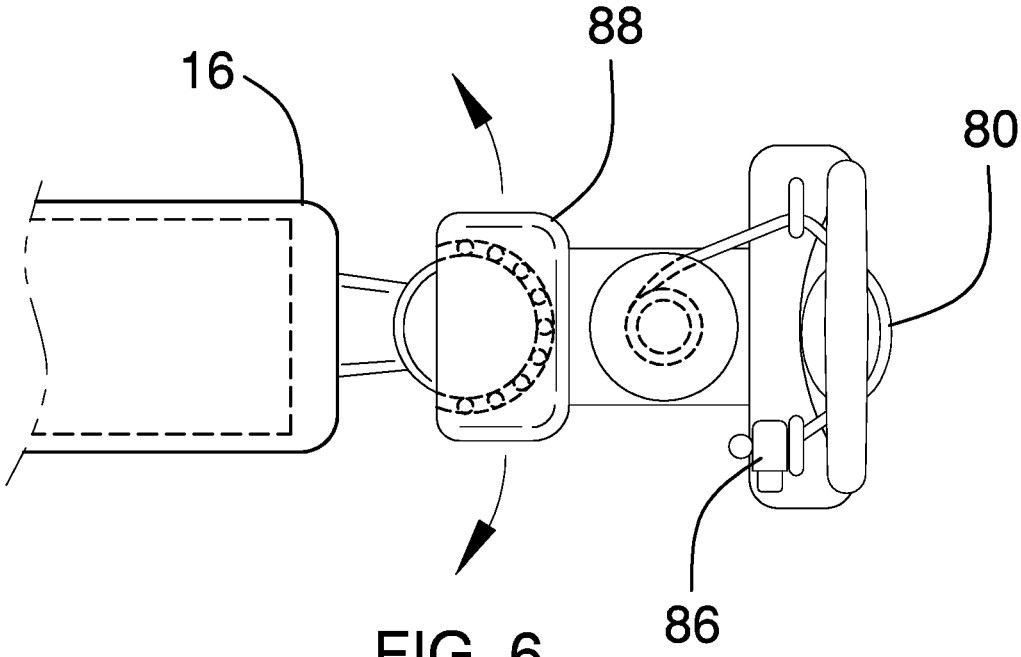
FIG. 6 is a cross-sectional view of an embodiment of the disclosure.

A cable 80 is coupled to the plate 74. The cable 80 also is selectively couplable to the plate 74. The cable 80 is configured to selectively and loopedly position around the dock cleat and the dock post, positioning the cable 80 to couple to the plate 74 to selectively couple the plate 74 to the dock cleat and the dock post. The cable 80 is selectively extensible from a reel 94 that is coupled to the plate 74, as shown in FIG. 6.

A pair of guides 82 is coupled singly to the plate 74 proximate to opposing edges 84 of the plate 74. The cable 80 is positioned through one of the guides 82. A cord lock 86 is coupled to the cable 80. The cord lock 86 is positioned to couple to the cable 80 so that the cord lock 86 abuts the other of the guides 82 to prevent retraction of the cable 80 into the reel 94, as shown in FIG. 6.

A ball joint 88 is positioned between the first end 70 of the rod 12 and the coupler 68 that is positioned on the first end 70, as shown in FIG. 5. The ball joint 88 is configured to allow vertical and lateral movement of the boat relative to the bar 16.

A pivot joint 90 is positioned between the second end 72 of the rod 12 and the coupler 68 that is positioned on the second end 72. The pivot joint 90 is configured to allow vertical movement of the boat relative to the dock.

A clamp 92 is coupled to the boat proximate to the rod 12, as shown in FIG. 7. The clamp 92 is positioned to couple to the rod 12 to stow the rod 12 when the rod 12 is not in use for securing the boat to the dock. The clamp 92 is C-clamp type and is spring-loaded.

In use, two or more of the assemblies 10 are deployed between the boat and the dock with the distance between the boat and the dock determined by the length of the rods 12. One of the couplers 68 of each assembly 10 is coupled to a cleat on the boat, while the other coupler 68 is coupled to either a dock cleat or a dock post. The assemblies 10 maintain the boat in a fixed position relative to the dock while allowing for up and down movement of the boat resulting from wave action.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A boat mooring assembly comprising:

a rod comprising a plurality of nested sections such that the rod is selectively extensible; and a pair of couplers coupled singly to a first end and a second end of the rod wherein the couplers are configured for coupling singly to a boat cleat and selectively to one of a dock cleat and a dock post for coupling the boat to a dock, each coupler comprising a plate having a first face coupled to the rod, the plate having a second face, the second face being concavely shaped, and a cable coupled to the plate, the cable being selectively couplable to the plate wherein the cable is configured for selectively loopedly positioning around the dock cleat and the dock post positioning the cable for coupling to the plate for selectively coupling the plate to the dock cleat and the dock post.

2. The assembly of claim 1, further including the cable being selectively extensible from a reel coupled to the plate.

3. The assembly of claim 2, further a pair of guides coupled singly to the plate proximate to opposing edges of the plate, the cable being positioned through one of the guides.

4. The assembly of claim 3, further including a cord lock coupled to the cable wherein the cord lock is positioned for coupling to the cable such that the cord lock abuts the other of the guides for preventing retraction of the cable into the reel.

5. The assembly of claim 1, further including a ball joint positioned between the first end of the rod and the coupler positioned on the first end wherein the ball joint is configured for allowing vertical and lateral movement of the boat relative to the bar.

6. The assembly of claim 1, further including a pivot joint positioned between the second end of the rod and the coupler positioned on the second end wherein the pivot joint is configured for allowing vertical movement of the boat relative to the dock.

7. The assembly of claim 1, further including a clamp configured for coupling to the boat proximate to the rod wherein the clamp is positioned for coupling to the rod for stowing the rod.

8. The assembly of claim 7, further including the clamp being C-clamp.

9. The assembly of claim 8, further including the clamp being spring-loaded.

10. A boat mooring assembly comprising:

a rod comprising a plurality of nested sections such that the rod is selectively extensible;

a pair of couplers coupled singly to a first end and a second end of the rod wherein the couplers are configured for coupling singly to a boat cleat and selectively to one of a dock cleat and a dock post for coupling the boat to a dock; and the rod further comprising a bar comprising a plurality of nested pieces wherein the nested pieces are selectively sequentially extensible, the nested pieces being tubular, a first endplate coupled to and extending from an upper face of the bar proximate to a first endpoint of the bar, a second endplate coupled to and extending from the upper face of the bar proximate to a second endpoint of the bar, a hole positioned in the second endplate, a housing fixedly coupled to and extending from the first endplate, the housing defining an interior space, the housing being tubular, the housing being open-ended, and a pipe rotatably coupled to the housing and positioned in the interior space, the pipe comprising a plurality of nested segments wherein the nested segments are selectively sequentially extensible concurrently with the nested pieces, the plurality of nested segments comprising an inner segment extending through the hole such that the pipe is positioned longitudinally along the upper face of the bar.

11. The assembly of claim 10, further including each nested piece comprising a pair of bar pins and a spring, the bar pins being coupled to and extendible from opposing faces of the nested piece, the spring being coupled to and extending between the bar pins such that the spring biases the bar pins to an extended configuration, each spring having a respective tension such that the springs have a variety of tensions wherein each spring is positioned for urging an associated pair of bar pins from an associated nested piece such that the associated pair of bar pins frictionally couples to an adjacent nested piece for sequentially extending the nested pieces.

12. The assembly of claim 10, further comprising:

a plurality of first fasteners, each first fastener being coupled to a respective nested piece of the bar; and a plurality of second fasteners, each second fastener being coupled to a respective nested segment of the pipe, the second fasteners being complementary to the first fasteners wherein each second fastener is positioned for coupling to a respective first fastener for fixedly positioning the plurality of nested sections of the rod.

13. The assembly of claim 12, further comprising:

a handle coupled to a terminus of the inner segment;

a cutout positioned in a side of the housing;

the second fastener comprising a pipe pin coupled to and extending from the respective nested segment; and the first fastener comprising a set of slots positioned in the respective nested piece of the bar wherein the handle is configured for grasping in a hand of a user for rotating the pipe relative to the housing such that each pipe pin positioned on a nested segment of the pipe is rotated into associated slots positioned in nested pieces of the bar for fixedly positioning the pipe and the bar.

14. A boat mooring assembly comprising:

a rod comprising a plurality of nested sections such that the rod is selectively extensible, the rod comprising:

a bar comprising a plurality of nested pieces wherein the nested pieces are selectively sequentially extensible, the nested pieces being tubular, each nested piece comprising a pair of bar pins and a spring, the bar pins being coupled to and extendible from opposing faces of the nested piece, the spring being coupled to and extending between the bar pins such that the spring biases the bar pins to an extended configuration, each spring having a respective tension such that the springs have a variety of tensions wherein each spring is positioned for urging an associated pair of bar pins from an associated nested piece such that the associated pair of bar pins frictionally couples to an adjacent nested piece for sequentially extending the nested pieces, a first endplate coupled to and extending from an upper face of the bar proximate to a first endpoint of the bar, a second endplate coupled to and extending from the upper face of the bar proximate to a second endpoint of the bar, a hole positioned in the second endplate, a housing fixedly coupled to and extending from the first endplate, the housing defining an interior space, the housing being tubular, the housing being open-ended, a cutout positioned in a side of the housing, a pipe rotatably coupled to the housing and positioned in the interior space, the pipe comprising a plurality of nested segments wherein the nested segments are selectively sequentially extensible concurrently with the nested pieces, the plurality of nested segments comprising an inner segment extending through the hole such that the pipe is positioned longitudinally along the upper face of the bar, a handle coupled to a terminus of the inner segment, a plurality of first fasteners, each first fastener being coupled to a respective nested piece of the bar, and a plurality of second fasteners, each second fastener being coupled to a respective nested segment of the pipe, the second fasteners being complementary to the first fasteners wherein each second fastener is positioned for coupling to a respective first fastener for fixedly positioning the plurality of nested sections of the rod, the second fastener comprising a pipe pin coupled to and extending from the respective nested segment, the first fastener comprising a set of slots positioned in the respective nested piece of the bar wherein the handle is configured for grasping in a hand of a user for rotating the pipe relative to the housing such that each pipe pin positioned on a nested segment of the pipe is rotated into associated slots positioned in nested pieces of the bar for fixedly positioning the pipe and the bar;

a pair of couplers coupled singly to a first end and a second end of the rod wherein the couplers are configured for coupling singly to a boat cleat and selectively to one of a dock cleat and a dock post for coupling the boat to the dock, each coupler comprising:

a plate having a first face coupled to the bar, the plate having a second face, the second face being concavely shaped, a cable coupled to the plate, the cable being selectively couplable to the plate wherein the cable is configured for selectively loopedly positioning around the dock cleat and the dock post positioning the cable for coupling to the plate for selectively coupling the plate to the dock cleat and the dock post, the cable being selectively extensible from a reel coupled to the plate, a pair of guides coupled singly to the plate proximate to opposing edges of the plate, the cable being positioned through one of the guides, and a cord lock coupled to the cable wherein the cord lock is positioned for coupling to the cable such that the cord lock abuts the other of the guides for preventing retraction of the cable into the reel;

a ball joint positioned between the first end of the rod and the coupler positioned on the first end wherein the ball joint is configured for allowing vertical and lateral movement of the boat relative to the bar;

a pivot joint positioned between the second end of the rod and the coupler positioned on the second end wherein the pivot joint is configured for allowing vertical movement of the boat relative to the dock; and a clamp configured for coupling to the boat proximate to the rod wherein the clamp is positioned for coupling to the rod for stowing the rod, the clamp being C-clamp, the clamp being spring-loaded.

* * * * *